US005156696A

United States Patent [19]

Kopian

[11] Patent Number: 5,156,696

[45] Date of Patent: Oct. 20, 1992

[54] METHOD OF MANUFACTURING A LATEX-PAPER FABRIC WHICH CLOSELY RESEMBLES HUMAN OR ANIMAL SKIN

[76] Inventor: Thomas A. Kopian, 21 Roslyn Dr., Glen Head, N.Y. 11545

[21] Appl. No.: 490,154

[22] Filed: Mar. 7, 1990

Related U.S. Application Data

[63] Continuation-in-part of Ser. No. 209,199, Jun. 20, 1988, Pat. No. 4,908,001.

[51] Int. Cl.[5] ..... B44C 3/00; A41G 7/00

[52] U.S. Cl. ..... 156/61; 156/63; 156/297; 156/324; 427/439

[58] Field of Search ..... 156/61, 63, 62.2, 62.6, 156/166, 297, 307.4, 307.5, 307.7, 324; 427/439; 428/302, 311.7

[56] References Cited

U.S. PATENT DOCUMENTS

| | | | |
|---|---|---|---|
| 1,917,755 | 7/1933 | Dewey | 427/439 X |
| 2,081,071 | 5/1937 | Scovil et al. | 156/61 |
| 2,173,242 | 9/1939 | Young | 427/439 |
| 2,184,139 | 12/1939 | Cunnington | 428/311.7 X |
| 2,184,140 | 12/1939 | Cunnington | 428/311.7 X |
| 2,592,747 | 4/1952 | Schumann | 427/439 X |
| 2,988,468 | 6/1961 | Strickel et al. | 428/302 |
| 4,397,701 | 8/1983 | Johnson et al. | 156/62 |

OTHER PUBLICATIONS

*Webster's Ninth New Collegiate Dictionary,* 1986, p. 852.

*Primary Examiner*—Jeff H. Aftergut
*Attorney, Agent, or Firm*—Kenneth A. Roddy

[57] ABSTRACT

A soft, flexible, latex-paper fabric is formed by saturating cellulose or paper sheets with pre-vulcanized latex, applying a layer of polyester batting to one side thereof, and drying the composition. The finished product is a soft, workable, skin-like fabric which is resilient, strong, and durable and has a backing of polyester batting. The resulting latex-paper fabric may be easily cut, sewn, draped, and used in the manner of other conventional fabrics. It can also be easily painted and decorated. The latex-paper fabric may be used to construct a variety of objects such as handbags, knapsacks, toys, and novelty items.

7 Claims, 2 Drawing Sheets

METHOD OF MANUFACTURING A LATEX-PAPER FABRIC WHICH CLOSELY RESEMBLES HUMAN OR ANIMAL SKIN

CROSS REFERENCE TO RELATED APPLICATIONS

This application is a continuation-in-part of copending application Ser. No. 07/209,199 filed Jun. 20, 1988, now U.S. Pat. No. 4,908,001.

BACKGROUND OF THE INVENTION

1. Field of the Invention

This invention relates generally to paper and latex fabrics, and more particularly to a method of manufacturing a latex-paper fabric using paper saturated with pre-vulcanized liquid latex and the resulting product thereof.

2. Brief Description of the Prior Art

Figures, such as animals or dolls, have been made from various material compositions and coated with rubber substances. Other figures have been made entirely of molded rubber and may be manufactured in either solid or hollow form. Most prior art rubber figures are expensive to fabricate and require expensive machinery and molds. Many rubber figures require vulcanization which is time consuming and costly.

Another popular type of animal or doll figure is known in the toy trade as a "plush" item. These "plush" figures, such as teddy bears for example, are filled with a soft or resilient material and have an outer covering of fabric and fur to give them a soft and squeezable quality.

It would therefore be desirable to provide a method of inexpensively manufacturing a new and improved fabric having a human-like outer skin and soft squeezable qualities which could be used to make a wide variety of figures and other articles.

There are several patents which disclose various methods of forming products utilizing latex materials.

Fischer, U.S. Pat. No. 2,325,385 discloses a method of maintaining a substantially uniform ratio of rubber solids to non-rubber solids in a bath of latex through which an absorbent material is passed and removes a portion of the latex.

Pereira, U.S. Pat. No. 2,185,924 discloses a process for making relief maps wherein a mold is sprayed with latex, glue is applied to a textile backing sheet, and after the glue has dried, a thin film of dilute latex is sprayed over the glue. The cavities between the two sheets are filled with cotton or felt fiber.

Fulton, U.S. Pat. No. 1,920,372 discloses a hard papier-mache figure which is covered with latex rubber by a dipping or spraying process.

Crane, U.S. Pat. No. 1,201,701 discloses a paper towel comprising a body of soft absorbent paper intersected by depressions of greatly compressed and sized paper and a waterproof backing secured to the body portion only along the depressions.

Kitawaga, U.S. Pat. No. 4,242,418 discloses a polyolefin-paper laminate used in making film which comprises a base paper, a copolymer of at least one diene monomer and at least one monovinyl substituted aromatic compound incorporated into or coated on the base paper and an extrusion coated polyolefin film layer thereon.

Asanuma et al, U.S. Pat. No. 4,269,937 discloses another photographic sensitive film material comprising a polyolefin coated paper.

Shaw et al, U.S. Pat. No. 4,341,839 discloses a method for the preparation of electrostatic paper masters having improved water and/or solvent resistance which comprises applying a plastic particle formulation to a base paper, then wetting the formed coating with a solvent to which the plastic particles are sensitive.

Although these patents teach various methods utilizing latex and paper materials, they do not suggest present method of making a latex-paper fabric and the resulting product thereof.

The present invention is distinguished over the prior art in general, and these patents in particular by a method of manufacturing a soft, flexible latex-paper fabric comprising the steps of saturating cellulose or paper sheets with pre-vulcanized latex, applying a layer of polyester batting to one side thereof, and drying the composition. The finished product is a soft, workable, skin-like fabric which is resilient, strong, and durable and has a backing of polyester batting. The resulting latex-paper fabric may be easily cut, sewn, draped, and used in the manner of other conventional fabrics. It can also be easily painted and decorated. The latex-paper fabric may be used to construct a variety of objects such as handbags, knapsacks, toys, and novelty items.

SUMMARY OF THE INVENTION

It is therefore an object of the present invention to provide a method of manufacturing a soft flexible latex-paper fabric which does not require expensive machinery and tooling thereby allowing the latex-paper fabric to be produced at lower cost than present methods.

It is another object of this invention to provide a method of manufacturing a soft flexible latex-paper fabric which is quickly accomplished and eliminates vulcanization procedures and reduces the time required for coloring the fabric.

It is another object of this invention to provide a method of manufacturing a soft flexible latex-paper fabric to produce a fabric simulative of human skin in texture and feel which is resilient and stretchable.

Another object of this invention is to provide a method of manufacturing a soft flexible latex fabric to produce a fabric which will allow designers, artisans, and craftsmen to create various articles.

Another object of this invention is to provide a method of manufacturing a soft latex-paper fabric wherein the resulting product can be selectively colored during the manufacturing process.

A further object of this invention is to provide a new and improved type of latex-paper fabric which is soft, flexible, stretchable and resilient and is simulative of human or animal skin.

A still further object of this invention is to provide a new and improved type of latex-paper fabric which may be sewn, cut, draped, and otherwise handled and formed in the manner of most other flexible fabrics.

Other objects of the invention will become apparent from time to time throughout the specification and claims as hereinafter related.

The above noted objects and other objects of the invention are accomplished by a method of manufacturing a soft, flexible latex-paper fabric comprising the steps of saturating cellulose or paper sheets with pre-vulcanized latex, applying a layer of polyester batting to one side thereof, and drying the composition. The finished product is a soft, workable, skin-like fabric which is resilient, strong, and durable and has a backing of polyester batting. The resulting latex-paper fabric may be easily cut, sewn, draped, and used in the manner of other conventional fabrics. It can also be easily painted and decorated. The latex-paper fabric may be used to construct a variety of objects such as handbags, knapsacks, toys, and novelty items.

DESCRIPTION OF THE PREFERRED EMBODIMENT

Figure 1:
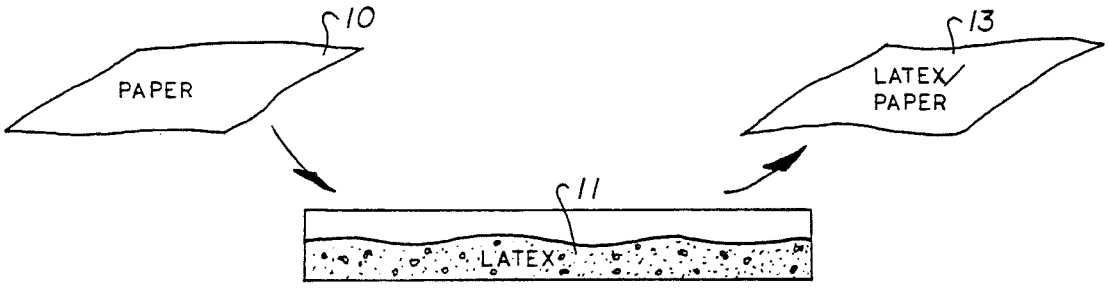
FIG. 1 is a schematic illustration of the step of saturating sheets of paper by running them through a bath of pre-vulcanized latex in accordance with a preferred method of making small quantities of a latex-paper fabric by hand.
Figure 2:
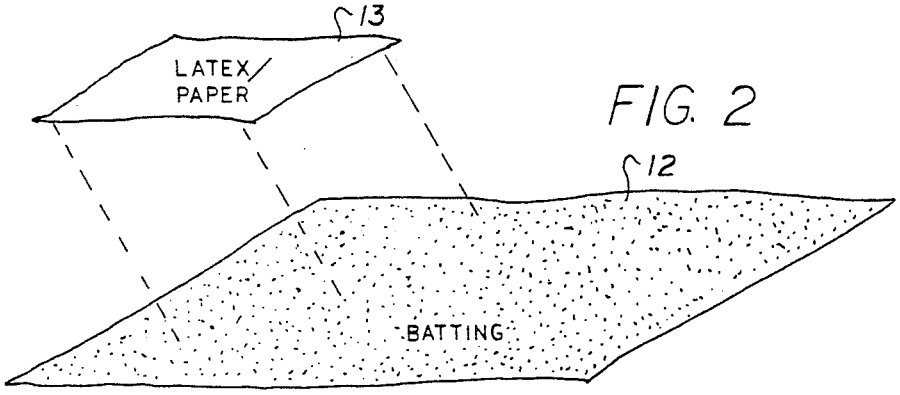
FIG. 2 is a schematic illustration of the latex saturated paper sheets being applied to a soft batting material in accordance with the method of making small quantities of the latex-paper fabric by hand.
Figure 3:
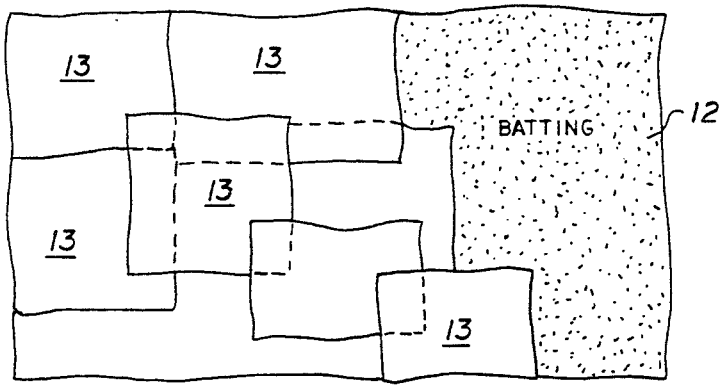
FIG. 3 is a schematic illustration of the latex saturated paper sheets being applied to a soft batting material in an overlapping pattern to form large sections of the latex-paper in accordance with the method of making the latex-paper fabric by hand.

FIGS. 1, 2, and 3 of the drawings are schematic illustrations of the steps in the preferred manufacturing process of making small quantities of a soft resilient latex-paper fabric by hand.

The first step in the preferred hand operation method of manufacturing the soft resilient latex-paper fabric, known as "rubber plush" is to prepare a quantity of squares, rectangles, or sheets of a soft absorbent cellulose material, such as paper 10, of sufficient size to be easily handled. Absorbent paper toweling is a suitable material because it has excellent absorption qualities, is readily available, and inexpensive. Paper toweling also can be obtained which has a "dimpled" surface texture and will give the subsequent finished fabric the appearance of goose flesh.

A quantity of pre-vulcanized liquid latex is poured into a tray or other suitable open-top container to create a latex bath 11. Coloring material may also be thoroughly mixed with the liquid latex in the bath 11 to form a colored latex bath having the general color of the desired finished fabric. Adding color to the liquid latex bath reduces the time required to otherwise subsequently color the finished fabric. Use of pre-vulcanized liquid latex greatly reduces the time required to produce the finished fabric and eliminates the vulcanization process. A rectangle or square sheet of suitable polyester batting material 12 is laid out flat near the liquid latex bath.

The absorbent cellulose or paper material sections 10 are run through, or dipped in, the liquid latex bath 11, and the excess liquid latex is squeezed out or shaken off to produce sections latex saturated sections 13 of cellulose or paper material.

As illustrated in FIGS. 2 and 3, the latex saturated cellulose or paper sections 12 are then applied to the polyester batting material 12. This step is repeated until the desired size or sheet is achieved. The sections of cellulose or paper material may be laid on top of the polyester batting sheet 13 with their edges overlapped. After all the sections have been laid out on the polyester batting, they are allowed to dry. As the latex dries, the overlapped edges will become bonded together to form a continuous integral sheet. The drying process may be expedited by drying the composition with a hair dryer. It should be understood that the polyester batting material could also be eliminated depending upon the consistency of the liquid latex used and the desired use of the fabric.

Figure 4:
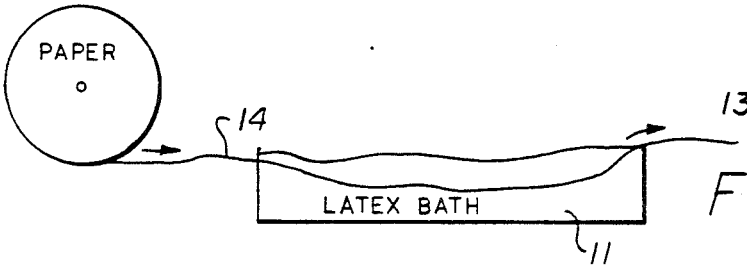
FIG. 4 is a schematic illustration of the step of saturating absorbent paper by running them through a bath of pre-vulcanized latex in accordance with a preferred method of mass producing large quantities of a latex-paper fabric.

FIGS. 4 through 7 illustrate schematically, a method of mass producing large quantities of the latex-paper fabric. As seen in FIG. 4, the absorbent cellulose or paper material 14 is provided in rolls. As described above, absorbent paper toweling may be used and may optionally provided in a form which has a "dimpled" surface texture. The absorbent cellulose or paper material is spooled off the roll and run through a bath of pre-vulcanized liquid latex 11. Coloring material may also be thoroughly mixed with the liquid latex in the bath 11 to form a colored latex bath having the general color of the desired finished fabric. Adding color to the liquid latex bath reduces the time required to otherwise subsequently color the finished fabric.

Figure 5:
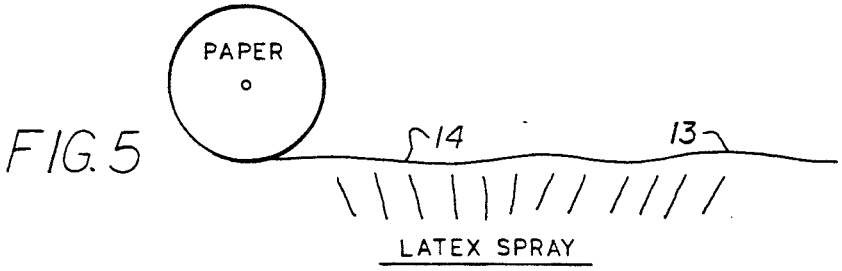
FIG. 5 is a schematic illustration of an alternate step of saturating absorbent paper by spraying with pre-vulcanized latex in accordance with a preferred method of mass producing large quantities of the latex-paper fabric.

Optionally, as illustrated in FIG. 5, the pre-vulcanized liquid latex 11 may be applied to the cellulose or paper material 14 by spraying it on as the material is spooled off the rolls.

Figure 6:
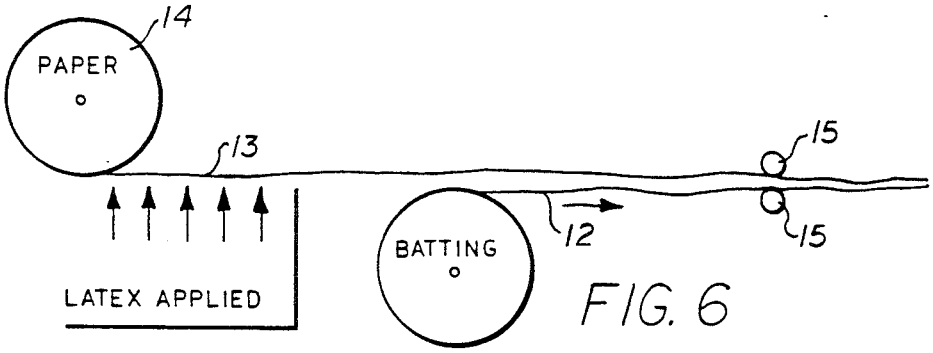
FIG. 6 is a schematic illustration of a soft batting material being applied to the latex saturated absorbent paper in accordance with the mass production method of making large quantities of the latex-paper fabric.
Figure 7:
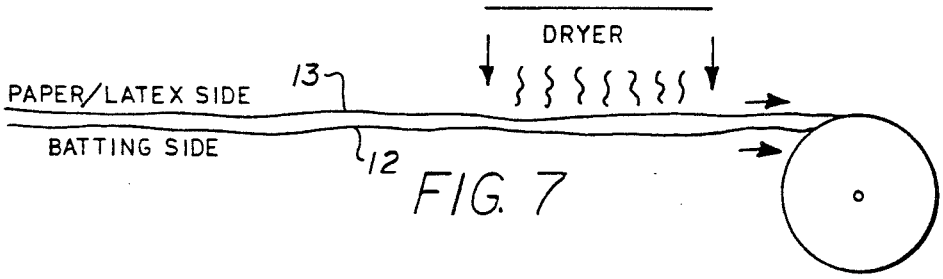
FIG. 7 is a schematic illustration of the latex saturated absorbent paper with a soft batting material during the drying operation in accordance with the mass production method of making large quantities of the latex-paper fabric.

As illustrated in FIG. 6, a roll of polyester batting material 12 is provided aft of the cellulose or paper material roll 14 and is spooled off the roll to engage one surface of the cellulose or paper material after the pre-vulcanized liquid latex has been applied. The composition is the feed through a set of rollers 15 to squeeze out the excess liquid latex and to firmly join the batting material to the cellulose or paper material.

It should be understood that the polyester batting material could also be eliminated depending upon the consistency of the liquid latex used and the desired use of the fabric.

After passing through the rollers 15, the composition is subjected to a dryer apparatus. The dryer apparatus may utilize air which may also be heated to facilitate drying. As the liquid latex dries, the cellulose or paper material and the polyester batting material will become bonded together to form a continuous integral sheet which may then be rolled on a roll 16. The rolls of the finished fabric may then be stored for shipping.

Figure 8:
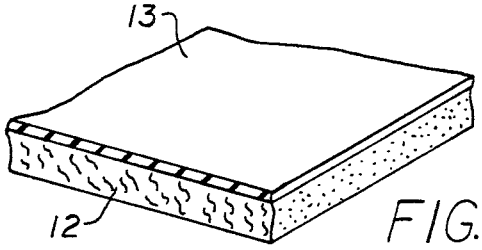
FIG. 8 is an enlarged cross section through a portion of the latex-paper fabric product produced in accordance with the present invention.

As seen in FIG. 8, the batting material forms a backing for the skin or fabric thus created and will strengthen the fabric to prevent tearing while increasing the softness and resiliency of the fabric. After drying, the sheet of latex-paper fabric produced forms a skin which closely resembles human or animal skin in texture and feel but which is highly resilient, stretchable, and durable. Depending upon the type of paper or paper toweling used, the skin or fabric may have the surface texture or "dimpled" appearance of the paper or toweling and may resemble goose flesh. Also depending upon the consistency and quantity of latex used, the surface texture and pattern of the cellulose or paper material be covered such that it is not visible to produce a smooth textured latex-paper skin or fabric.

Additional latex may be applied to the fabric with a sponge or brush to effect various other surface textures. The latex-paper fabric may be easily sewn, cut, draped, or otherwise handled and formed in the manner of most other flexible fabrics. The latex-paper fabric can also be easily decorated or painted to add finishing touches or create additional surface features and effects such as, highlights, or shadows.

While this invention has been described fully and completely with special emphasis upon a couple of preferred methods and the product thereof, it should be understood that within the scope of the appended claims the invention may be practiced otherwise than as specifically described herein.

I claim:

1. A method of manufacturing a soft resilient latex-paper fabric which closely resembles human or animal skin in texture and feel comprising the steps of;

providing a sheet of soft absorbent paper toweling, providing a sheet of polyester batting material, providing a bath of pre-vulcanized liquid latex, mixing coloring material with said pre-vulcanized liquid latex to form a colored latex bath, saturating said absorbent paper toweling in said pre-vulcanized liquid latex bath, removing said saturated absorbent paper toweling from said bath and removing the excess liquid latex, joining said sheet of latex saturated paper toweling with said sheet of polyester batting material, and drying the latex saturated paper toweling sand polyester batting material sheets to bond said latex saturated paper toweling sheets to said polyester sheet and form a unitary latex-paper fabric having a polyester backing.

2. The method according to claim 1 in which said sheet of soft absorbent paper toweling is provided on a roll, said sheet of polyester batting material is provided on a roll aft of said roll of paper toweling, said step of saturating said soft absorbent paper toweling in said pre-vulcanized liquid latex bath includes spooling said sheet of paper toweling from the roll and feeding it through said bath of pre-vulcanized liquid latex, and said step of joining said sheet of latex saturated paper toweling with said sheet of polyester batting material includes spooling said sheet of polyester batting material off the roll into engagement with the surface of said latex saturated paper toweling, said step of removing said latex saturated absorbent paper toweling from said bath and removing the excess liquid latex includes feeding said latex saturated paper toweling and polyester batting material engaged therewith through a set of rollers to remove the excess liquid latex, and said step of drying said latex saturated paper toweling includes feeding said latex saturated paper toweling and polyester batting material engaged thereto through a drying apparatus.

3. The method according to claim 2 including the further step of after drying said latex saturated paper toweling and batting material engaged thereto feeding it onto a roll for storage.

4. A method of manufacturing a soft resilient latex-paper fabric which closely resembles human or animal skin in texture and feel comprising the steps of:

providing a plurality of sheets of soft absorbent paper toweling, providing a sheet of polyester batting material, providing a bath of pre-vulcanized liquid latex, mixing coloring material with said pre-vulcanized liquid latex to form a colored latex bath, saturating each said absorbent paper toweling sheet in said pre-vulcanized liquid latex bath, removing each said saturated absorbent paper toweling sheet from said liquid latex bath and removing the excess liquid latex from said sheets, placing each said sheet of latex saturated paper toweling on said sheet of polyester batting material such that the side edges of adjacent sheets are overlapped, and drying the overlapped sheets of latex saturated paper toweling and polyester batting material sheet to bond the overlapped side edges together and to said polyester sheet to form a unitary sheet of latex-paper fabric having a polyester backing.

5. A method of manufacturing a soft resilient latex-paper fabric which closely resembles human or animal skin in texture and feel comprising the steps of;

providing a roll of soft absorbent paper toweling, providing a roll of polyester batting material, providing a source of pre-vulcanized liquid latex, mixing coloring material with said pre-vulcanized liquid latex, spooling said paper toweling from its roll and saturating it with said pre-vulcanized liquid latex, spooling said polyester batting material off its roll into engagement with the surface of said latex saturated paper toweling, feeding said latex saturated paper toweling and polyester batting material engaged therewith through a set of rollers to remove the excess liquid latex, feeding said latex saturated paper toweling and polyester batting material engaged thereto past drying means to dry said latex saturated paper toweling and polyester batting material to bond said latex saturated paper toweling to said polyester batting material and form a unitary latex-paper fabric having a polyester backing.

6. The method according to claim 5 in which said step of saturating said soft absorbent paper toweling with said pre-vulcanized liquid latex bath comprises spooling said sheet of paper toweling from the roll and spraying it with pre-vulcanized liquid latex.

7. The method according to claim 5 in which said step of saturating said soft absorbent paper toweling with said pre-vulcanized liquid latex bath comprises spooling said sheet of paper toweling from the roll and feeding it through a bath of pre-vulcanized liquid latex.

* * * * *